United States Patent [19]

Metrailer et al.

[11] 4,204,943

[45] May 27, 1980

[54] COMBINATION HYDROCONVERSION, COKING AND GASIFICATION

[75] Inventors: William J. Metrailer; Roby Bearden, Jr.; Clyde L. Aldridge, all of Baton Rouge, La.

[73] Assignee: Exxon Reserch & Engineering Co., Florham Park, N.J.

[21] Appl. No.: 942,689

[22] Filed: Sep. 15, 1978

Related U.S. Application Data

[63] Continuation-in-part of Ser. No. 889,744, Mar. 24, 1978.

[51] Int. Cl.[2] ..... C10G 37/06

[52] U.S. Cl. ..... 208/50; 208/8 LE; 208/127; 208/157

[58] Field of Search ..... 208/50, 127, 8 LE, 157

[56] References Cited

U.S. PATENT DOCUMENTS

| | | | |
|---|---|---|---|
| 2,738,307 | 3/1956 | Beckberger | 208/55 |
| 3,617,481 | 11/1971 | Voorhies et al. | 208/50 |
| 3,702,516 | 11/1972 | Luckenbach | 208/127 X |
| 3,779,900 | 12/1973 | Molstedt | 208/127 |
| 3,923,635 | 12/1975 | Shulman et al. | 208/127 X |

*Primary Examiner*—Herbert Levine

*Attorney, Agent, or Firm*—Marthe L. Gibbons

[57] ABSTRACT

A combination slurry hydroconversion, coking and coke gasification process is provided wherein carbonaceous solids having an average particle size of less than 10 microns in diameter or the ashes thereof are used as a catalyst in the hydroconversion stage.

22 Claims, 1 Drawing Figure

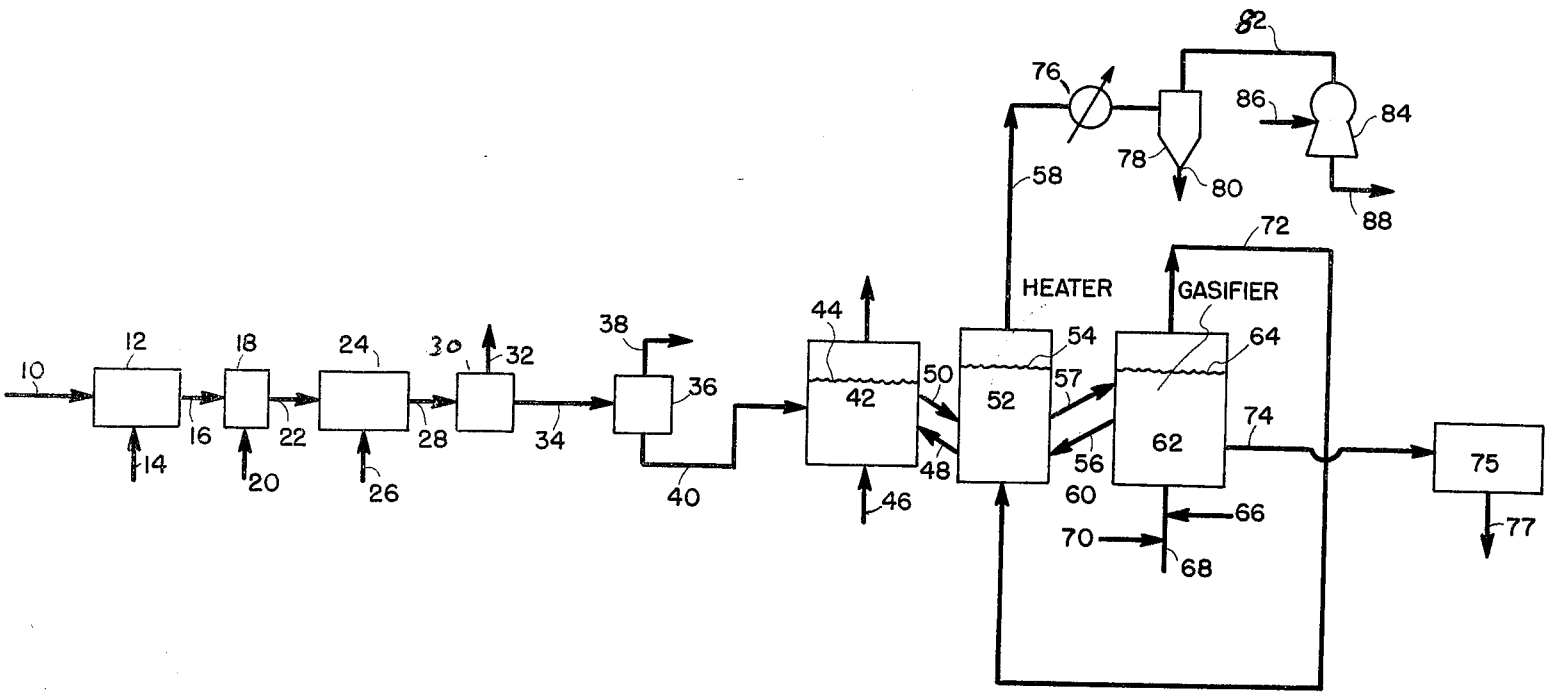
GASIFIER
HEATER

COMBINATION HYDROCONVERSION, COKING AND GASIFICATION

CROSS REFERENCE TO RELATED APPLICATIONS

This application is a continuation-in-part of U.S. application Ser. No. 889,744 filed Mar. 24, 1978, the teachings of which are hereby incorporated by specific reference.

BACKGROUND OF THE INVENTION

1. Field of the Invention

This invention relates to a combination process for upgrading carbonaceous materials to produce normally liquid hydrocarbonaceous products. It particularly relates to a combination slurry hydroconversion, coking and coke gasification process wherein carbonaceous solids having an average diameter of less than 10 microns or ashes thereof are used as catalyst in the slurry hydroconversion process.

2. Description of the Prior Art

Catalytic slurry processes for the hydrogenative conversion of heavy oils are known. See, for example, U.S. Pat. Nos. 3,617,503; 3,297,563 and 3,622,498.

It is also known to produce hydrogen-containing gases and coke by integrated fluid coking and coke gasification processes such as those disclosed in U.S. Pat. Nos. 3,661,543; 3,702,516; and 3,759,676, the teachings of which are hereby incorporated by reference.

A process is known for upgrading heavy mineral oils by reaction with hydrogen in the presence of a catalyst comprising a solid carbon-containing material and an alkali metal component. See, U.S. Pat. No. 3,923,635.

U.S. Pat. No. 3,617,481 discloses a combination hydrotreating, coking and coke gasification process in which the metals-containing coke gasification residue is used as catalyst in the hydrotreating stage.

It has now been found that a combination slurry hydroconversion, coking and coke gasification process in which coke or coke derived solids, after reduction in size to particles of less than about 10 microns, are used as a catalyst for the hydroconversion process will provide advantages that will become apparent in the ensuing description.

SUMMARY OF THE INVENTION

In accordance with the invention there is provided, a process for upgrading a carbonaceous chargestock which comprises: (a) adding to said chargestock catalytic solids having an average particle size of less than about 10 microns in diameter to form a mixture, said solids being selected from the group consisting of fluid coke, delayed coke, coal coke, carbonaceous residue derived from the gasification of coke, an ash of said coke, an ash of said carbonaceous residue and mixtures thereof; (b) reacting the chargestock containing said catalytic solids with a molecular hydrogen-containing gas under hydroconversion conditions in a hydroconversion zone to produce a hydrocarbonaceous oil product; (c) separating a heavy oil fraction from said hydrocarbonaceous oil product; (d) subjecting at least a portion of said separated oil fraction to coking conditions in a coking zone to produce coke, and (e) reacting at least a portion of said coke with steam and a molecular oxygen-containing gas to produce a hot gaseous stream containing hydrogen and a solid carbonaceous residue.

BRIEF DESCRIPTION OF THE DRAWING

The FIGURE is a schematic flow plan of one embodiment of the invention.

DESCRIPTION OF THE PREFERRED EMBODIMENT

The combination process of the present invention comprises slurry hydroconversion, coking and coke gasification. The coking process may be delayed coking or fluid coking. The catalysts used in the hydroconversion stage are solids having an average particle size of less than about 10 microns in diameter. The solids may be delayed coke particles, fluid coke, coal coke, carbonaceous residue derived from the gasification of coal coke, carbonaceous residue derived from gasification of delayed coke, carbonaceous residue derived from gasification of fluid coke, ashes derived from burning of any of these solids and mixtures thereof. Delayed coking conditions are well known and include a temperature ranging from about 775° F. to about 1000° F. and a pressure ranging from about 10 to about 200 psig. The preferred embodiment will be described with reference to the accompanying FIGURE.

Referring to the FIGURE, a carbonaceous material is passed by line 10 to a mixing zone 12. Suitable carbonaceous materials for introduction into the mixing zone include heavy and reduced petroleum crudes, atmospheric distillation bottoms, vacuum distillation bottoms, pitch, asphalt, bitumen, other heavy hydrocarbon residua, liquids derived from coal liquefaction processes, including coal liquefaction bottoms, shale oil, tar sand oil; slurries of coal and hydrogen donor solvents; slurries of coal in other non-aqueous liquid media such as petroleum residua; and mixtures of any of these carbonaceous materials. Catalytic solids produced, as will hereinafter be described, are introduced into mixing zone 12 by line 14. Optionally, the liquid feed may be used to scrub the gases from the heater, after partial cooling, and to recover the catalytic fines. Desirably, a sufficient amount of catalytic solids are added to the mixing zone to provide a content of the solids from about 0.1 to 20 weight percent based on the carbonaceous chargestock to the mixing zone, preferably to provide solids from about 0.5 to about 10 weight percent based on the carbonaceous chargestock, more preferably from about 1 to about 5 weight percent solids based on the chargestock.

If desired, other catalytic components, such as red mud, may be added to the chargestock. The resulting mixture is removed from mixing zone 12 by line 16 and, optionally, passed to a pretreatment zone 18 where the mixture is contacted with a gas comprising hydrogen sulfide alone or a gas comprising hydrogen and from about 1 to about 90 mole percent hydrogen sulfide. Pretreatment zone, when used, is operated at a temperature ranging from about 615° to 780° F. and at a pressure ranging from about 500 to 5000 psig. The pretreated slurry is removed from pretreatment zone 18 by line 22 and passed to hydroconversion zone 24. When no pretreatment is used, the slurry is passed from the mixing zone to the hydroconversion zone. The term "hydroconversion" is used herein to designate a process conducted in the presence of hydrogen in which at least a portion of the heavy constituents of the chargestock is converted to lower boiling hydrocarbon products. A hydrogen-containing gas is introduced into the hydroconversion zone 24 by line 26. As will readily be apparent, this gas could be introduced into the feed line entering the hydroconversion zone. Optionally, the hydrogen-containing gas may also comprise from about 1 to about 10 mole percent of hydrogen sulfide, preferably from about 2 to about 7 mole percent hydrogen sulfide. The hydroconversion zone is maintained at a temperature ranging from about 650° to about 1000° F., preferably from about 790° to about 900° F., more preferably from about 800° to about 850° F. and at a hydrogen partial pressure ranging from about 500 to about 5000 psig, preferably from about 1000 to about 3000 psig. The slurry of carbonaceous feed and catalytic solids is introduced into the hydroconversion zone at a space velocity ranging from about 0.1 to 10 volumes of chargestock per hour per volume of reactor, preferably from about 0.25 to about 6 V/Hr./V. The hydroconversion zone effluent is removed by line 28 and passed to a gas-liquid separation zone 30. The gaseous effluent of separation zone 30 is removed by line 32. Since this gas comprises hydrogen, it may be recycled, if desired after prior cleanup, for use as hydrogen in the hydroconversion zone. The liquid product is removed by line 34 and passed to a separation zone 36 from which a lighter carbonaceous oil, such as, for example, a fraction boiling below 1050° F. at atmospheric pressure is recovered by line 38. The bottoms portion or heavy oil fraction is removed by line 40 and passed as feed to a coking zone 42 in which is maintained a fluidized bed of solids (e.g. coke particles of 40 to 1000 microns in size) having an upper level indicated at 44. A fluidizing gas, e.g. steam, is admitted at the base of the coking reactor through line 46 in an amount sufficient to obtain a superficial fluidizing gas velocity in the range of 0.5 to 5 feet per second. Coke at a temperature above the actual coking temperature, for example, at a temperature from about 100 to about 800 Fahrenheit degrees in excess of the actual operating temperature of the coking zone, is admitted into the coking zone by line 48 in an amount sufficient to maintain the coking temperature in the range of about 850° to about 1400° F., preferably at a temperature ranging from about 900° to about 1200° F. The pressure in the coker is maintained in the range from about 5 to about 150 psig, preferably from about 5 to about 45 psig. The lower portion of the coker serves as stripping zone to remove occluded hydrocarbons from the coke. A stream of coke is withdrawn from the stripping zone by line 50 and circulated to a heater 52.

In heater 52, stripped coke from the coker is introduced by line 50 to a fluid bed of hot coke having an upper level indicated at 54. The bed is partially heated by passing a gaseous stream into the heater by line 72. This gaseous stream is the effluent of a gasification zone as will be described hereinafter. Supplemental heat is supplied by coke circulating in line 56. The gaseous effluent of the heater is removed by line 58. The heater gaseous effluent, containing entrained solid carbonaceous fines, is passed by line 58, if desired through an indirect heat exchanger 76 and then into a cyclone 78 in which a portion of the entrained solid fines is separated and removed from the cyclone as dry fines by line 80. A gaseous hydrogen-containing stream, including the remaining entrained solids, is removed from cyclone 78 by line 82 and passed to a wet scrubber 84 such as, for example, a venturi scrubber, a packed bed, a wet cyclone or other conventional equipment, in which the solids-containing gas is scrubbed with a liquid introduced by line 86. Optionally, the liquid used may be the carbonaceous feed of the process. At least a portion of the solids present in the gaseous stream is separated from the gas to form with the scrubbing liquid a solid fines-liquid slurry which is removed from the scrubber by line 88. The carbonaceous solid fines are recovered from the liquid slurry by conventional means. The recovered fines have an average particle size of less than about 10 microns in diameter, preferably a particle size of less than 5 microns in diameter, and have surface areas of less than 50 square meters per gram. These recovered carbonaceous solid fines are catalytic in nature and, optionally, may be used to supplement the catalytic solids of the present invention in the hydroconversion stage. Instead of recovering the fines by a wet scrubbing method, the fines may be recovered by electrostatic precipitation. Alternatively, the separated carbonaceous fines may be burned by heating them in the presence of a molecular oxygen-containing gas to remove most of the carbon present therein and to produce an ash having an average particle size of less than about 5 microns in diameter which also may be used to supplement the catalyst in the hydroconversion stage of the present invention. Furthermore, if desired, the carbonaceous fines or the ashes derived therefrom may be sulfided in a conventional way prior to passing them to the hydroconversion stage to be used in combination with the catalyst of the present invention.

Hot coke is removed from the fluidized bed in heater 52 and recycled to the coking zone by line 48 to supply heat thereto. Another portion of the coke is removed from heater 52 by line 57, and passed to a gasification zone 62 in gasifier 60 in which is maintained a bed of fluidized coke having a level indicated at 64. The gasification zone is maintained at a temperature ranging from about 1200° to about 2000° F. and at a pressure ranging from about 5 to about 150 psig, preferably at a pressure ranging from about 10 to about 60 psig.

A molecular oxygen-containing gas, such as air, commercial oxygen or air enriched with oxygen, is introduced into line 68 by line 66 and steam is introduced into line 68 by line 70. The stream of line 68 is passed into the gasifier. Contact of the coke with the steam and oxygen-containing gas under gasification conditions in the gasifier produces a hydrogen-containing gas and a carbonaceous solid residue. The hydrogen-containing gas, which comprises entrained solid fines, is removed from the gasifier by line 72 and passed into heater 52 from which the stream will be recovered by line 58. Alternatively, at least part of the gases may be passed into a separate solids recovery system (not shown). A carbonaceous residue is removed from the gasifier by line 74. This product contains metals derived from the oil or coal feed, that is, usually vanadium, iron and nickel, and, in addition, any of the added catalytic components. The carbonaceous residue is passed by line 74 to particle reduction zone 75 to produce solids having an average size of less than about 10 microns in diameter. The resulting small particle size carbonaceous residue recovered by line 77 is suitable for use as catalyst in the hydroconversion stage of the present invention. The particle size reduction can be performed by grinding, attriting or other conventional techniques known in the art of particle size reduction. The small particle size carbonaceous residue recovered by line 77 may be added to mixing zone 12 as such. Alternatively, the separated carbonaceous residue may be burned by heating it in the presence of a molecular oxygen-containing gas to remove most of the carbon therefrom and to produce an ash having an average diameter of less than 10 microns. This ash is also suitable as catalyst for the hydroconversion stage of the present invention. The ash may be used alone or in combination with the less than 10 micron particles of carbonaceous residue. Furthermore, as previously stated, the solid fines recovered from the wet scrubbing process may also be used in combination with the catalyst of the present invention. If desired, the less than 10 micron particles of carbonaceous residue and/or the ash derived therefrom may be sulfided in a conventional way prior to being used in the hydroconversion stage.

The following example is presented to illustrate the invention.

EXAMPLE

The relative effectiveness (concentration equivalent basis on feed) of "as-obtained" gasifier solids, reduced particle size solids and burned gasifier solids (ash) for controlling the hydroconversion of Cold Lake crude is summarized in Table I. The objective of the experiment was to convert the feed Conradson carbon components to liquid or liquid plus light gas while suppressing the formation of reactor surface fouling pyrolytic coke deposits. As noted in run 60-R-31, the "as-obtained" gasifier solids are not very effective. Coke was suppressed relative to the catalyst free control run (R-34) but the yield of coke was still high, that is, 3.6% on feed and much of it was found plated on reactor surfaces. Further, Conradson carbon conversion to non-coke products was only 21%. In run 30-R-24, it is shown that substantially improved hydroconversion performance was obtained when particle size of the gasifier solids was reduced (by grinding) from ~150 to ~3 microns. Coke yield was down to 1.9 wt. % on feed. Fouling deposits of pyrolytic coke were slight and 37.4% of feed Conradson carbon was converted to non-coke products. Finally, in run 30-R-46, it was shown that the ash obtained from a low temperature (800° F.) burn of the "as-obtained" solids was an exceptionally good catalyst. Fouling coke was completely suppressed and 51.9% of feed Conradson carbon has been converted to non-coke products.

TABLE I

COLD LAKE CONVERSION RESULTS

Pretreat @ 725° F. for 30 min. with 13% $H_2S$, 87% $H_2$, Average Pressure about 2400 psig
Hydroconversion @ 820° F. for 60 min. under 2500 average psig $H_2$

| Run No. | R-34 | 60-R-31 | 30-R-24 | 30-R-46 |
|---|---|---|---|---|
| Catalyst | None | "as-obtained" gasifier solids | Ground solids | Burned solids, ash |
| Wt. % on Feed | — | 1.6 | 1.6 | 1.6 |
| Particle size, microns | — | ~150 | ~3 | ~2 |
| $C_1$-$C_4$ gas, Wt. % on Feed | 6.5 | 4.6 | 4.1 | 2.9 |
| Coke, Wt. % on Feed | 5.5 | 3.6 | 1.9 | 0.4 |
| Con. carbon conv. to non-coke products, % | 1.4 | 21.0 | 37.4 | 51.9 |
| Coke deposits on reactor surface | yes, heavy | yes, heavy | yes, slight | None |

What is claimed is:

1. A process for upgrading a liquid-containing carbonaceous chargestock which comprises:

(a) adding to said chargestock hydroconversion catalytic solids having an average particle size of less than about 10 microns in diameter to form a mixture, said solids being selected from the group consisting of fluid coke, delayed coke, coal coke, carbonaceous residue derived from the gasification of coke, an ash of said coke, an ash of said carbonaceous residue and mixtures thereof;

(b) reacting the chargestock containing said catalytic solids as a slurry with a molecular hydrogen-containing gas under hydroconversion conditions in a hydroconversion zone to produce an upgraded hydrocarbonaceous oil product;

(c) separating a heavy oil fraction from said hydrocarbonaceous oil product;

(d) subjecting at least a portion of said separated oil fraction to coking conditions in a coking zone to produce coke, and (e) reacting at least a portion of said coke with steam and a molecular oxygen-containing gas to produce a hot gaseous stream containing hydrogen and a solid carbonaceous residue.

2. The process of claim 1 wherein said coking zone is a delayed coking zone operated at delayed coking conditions.

3. The process of claim 1 wherein said coking zone is a fluid coking zone operated at fluid coking conditions.

4. The process of claim 1 or 2 wherein said carbonaceous residue of step (a) is derived from gasification of delayed coke.

5. The process of claim 1 or 2 wherein said carbonaceous residue is derived from gasification of fluid coke.

6. A process for upgrading a liquid-containing carbonaceous chargestock which comprises:

(a) adding to said chargestock hydroconversion catalytic solids having an average particle size of less than about 10 microns in diameter to form a mixture, said solids being selected from the group consisting of fluid coke, delayed coke, coal coke, a carbonaceous residue derived from gasification of coke, an ash of said coke, an ash of said carbonaceous residue and mixtures thereof;

(b) reacting the chargestock containing said catalytic solids as a slurry with a molecular hydrogen-containing gas under hydroconversion conditions in a hydroconversion zone to produce an upgraded hydrocarbonaceous oil product;

(c) separating a heavy oil fraction from said hydrocarbonaceous oil product;

(d) contacting at least a portion of said separated heavy oil fraction with a bed of fluidized solids maintained in a fluid coking zone under fluid coking conditions to form coke, said coke depositing on said fluidized solids;

(e) introducing a portion of said solids with a coke deposition thereon into a heating zone operated at a temperature greater than said coking zone temperature to heat said portion of solids;

(f) recycling a first portion of heated solids from said heating zone to said coking zone;

(g) introducing a second portion of said heated solids to a fluid bed gasification zone maintained at a temperature greater than the temperature of said heating zone;

(h) reacting said second portion of heated solids in said gasification zone with steam and a molecular oxygen-containing gas to produce a hot gaseous stream containing hydrogen and a solid carbonaceous residue;

(i) introducing said hot gaseous stream containing hydrogen and entrained solids into said heating zone;

(j) recovering from said heating zone the resulting cooled gaseous stream containing hydrogen and entrained solid carbonaceous fines, and (k) separating at least a portion of said solid carbonaceous fines from said cooled gaseous stream.

7. The process of claim 6 wherein said carbonaceous residue of step (a) is derived from gasification of delayed coke.

8. The process of claim 6 wherein said carbonaceous residue of step (a) is derived from gasification of fluid coke.

9. The process of claim 6 wherein said solid carbonaceous residue of step (h) is subjected to a particle reduction step to produce particles having an average diameter of less than about 10 microns and wherein at least a portion of the resulting small particles is recycled to said chargestock of step (a).

10. The process of claim 6 wherein said carbonaceous residue of step (h) is burned to produce ash particles having an average particle size of less than about 10 microns in diameter, and wherein at least a portion of the resulting ash particles are recycled to said chargestock of step (a).

11. The process of claim 6 wherein at least a portion of said solid carbonaceous fines of step (k) is recycled to said chargestock of step (a).

12. The process of claim 6 wherein prior to step (b), said mixture of chargestock and carbonaceous solids is treated with a gas comprising hydrogen and from about 1 to about 90 mole percent hydrogen sulfide.

13. The process of claim 12 wherein said treatment is conducted at a temperature ranging from about 615° to about 980° F. and at a pressure ranging from about 500 to about 5000 psig.

14. The process of claim 6 wherein said catalytic solids are added to said chargestock in an amount sufficient to provide from about 0.1 to 20 weight percent solids, based on said chargestock.

15. The process of claim 6 wherein said catalytic solids are added to said chargestock in an amount sufficient to provide from about 0.5 to about 10 weight percent solids, based on said chargestock.

16. The process of claim 6 wherein said catalytic solids are added to said chargestock in an amount sufficient to provide from about 1 to about 5 weight percent solids, based on said chargestock.

17. The process of claim 6 wherein said hydroconversion conditions include a temperature ranging from about 650° F. to about 1000° F. and a hydrogen partial pressure ranging from about 500 psig to about 5000 psig.

18. The process of claim 6 wherein said hydroconversion conditions include a temperature ranging from about 790° to about 900° F. and a hydrogen partial pressure ranging from about 1000 to about 3000 psig.

19. The process of claim 6 wherein said fluid coking conditions include a temperature ranging from about 850° to about 1400° F. and a pressure ranging from about 5 to about 150 psig.

20. The process of claim 6 wherein said gasification conditions include a temperature ranging from about 1200° to about 2000° F. and a pressure ranging from about 5 to about 150 psig.

21. The process of claim 1 or claim 6 wherein said chargestock comprises a hydrocarbonaceous oil.

22. The process of claim 1 or claim 6 wherein said chargestock comprises coal.

* * * * *